United States Patent [19]

Byczynski et al.

[11] Patent Number: 5,065,584

[45] Date of Patent: Nov. 19, 1991

[54] HOT GAS BYPASS DEFROSTING SYSTEM

[75] Inventors: Dean G. Byczynski, Milwaukee; William A. Reed, Cedarburg, both of Wis.

[73] Assignee: U-Line Corporation, Milwaukee, Wis.

[21] Appl. No.: 559,484

[22] Filed: Jul. 30, 1990

[51] Int. Cl.[5] ..... F25B 41/00

[52] U.S. Cl. ..... 62/81; 62/196.4; 62/151

[58] Field of Search ..... 62/196.4, 324.5, 81, 62/151; 165/17

[56] References Cited

U.S. PATENT DOCUMENTS

| | | | |
|---|---|---|---|
| 1,827,410 | 10/1931 | Warren | 62/81 |
| 2,001,027 | 5/1935 | Kitzmiller | 62/2 |
| 2,069,201 | 2/1937 | Allison | 62/3 |
| 2,281,770 | 5/1942 | Hoesel | 62/115 |
| 2,596,036 | 5/1952 | MacDougall | 62/151 |
| 2,710,507 | 6/1955 | Ashley | 62/4 |
| 2,888,808 | 6/1959 | Jacobs | 62/196.4 |
| 2,970,816 | 2/1961 | McCarty | 165/17 |
| 3,177,675 | 4/1965 | Kogel | 62/151 |
| 3,332,251 | 7/1967 | Watkins | 62/81 |
| 3,370,438 | 2/1968 | Hopkinson | 62/196.4 |
| 3,555,842 | 1/1971 | Bodcher | 62/196.4 |
| 3,788,089 | 1/1974 | Graves . | |
| 4,146,085 | 3/1979 | Wills | 236/94 |
| 4,325,223 | 4/1982 | Cantley | 62/126 |
| 4,565,070 | 1/1986 | Raymond | 62/81 |
| 4,774,814 | 10/1988 | Yingst et al. | 62/126 |

*Primary Examiner*—Albert J. Makay
*Assistant Examiner*—William C. Doerrler
*Attorney, Agent, or Firm*—Quarles & Brady

[57] ABSTRACT

A refrigeration system including a compressor, condenser, capillary tube and evaporator includes a hot gas bypass defrosting capability provided by a bypass means around the capillary tube. Defrosting is achieved by the use of hot, uncondensed refrigerant, without requiring a reversal of the flow of refrigerant through the system. An exemplary bypass means includes a solenoid valve and associated tubing to form an alternate, low restriction path for the refrigerant to bypass the capillary tube. When the solenoid valve is closed, refrigerant is forced through the capillary tube for normal refrigeration. However, when the solenoid valve is open, condensation of refrigerant in the condenser is inhibited, and hot refrigerant gas is delivered directly to the evaporator for defrosting. The solenoid valve is controlled in response to the total accumulated running time of the compressor for improved control of the defrosting cycles.

4 Claims, 2 Drawing Sheets

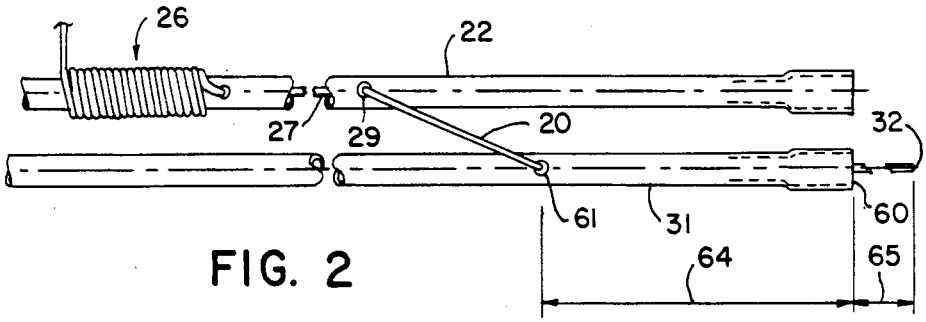
FIG. 2
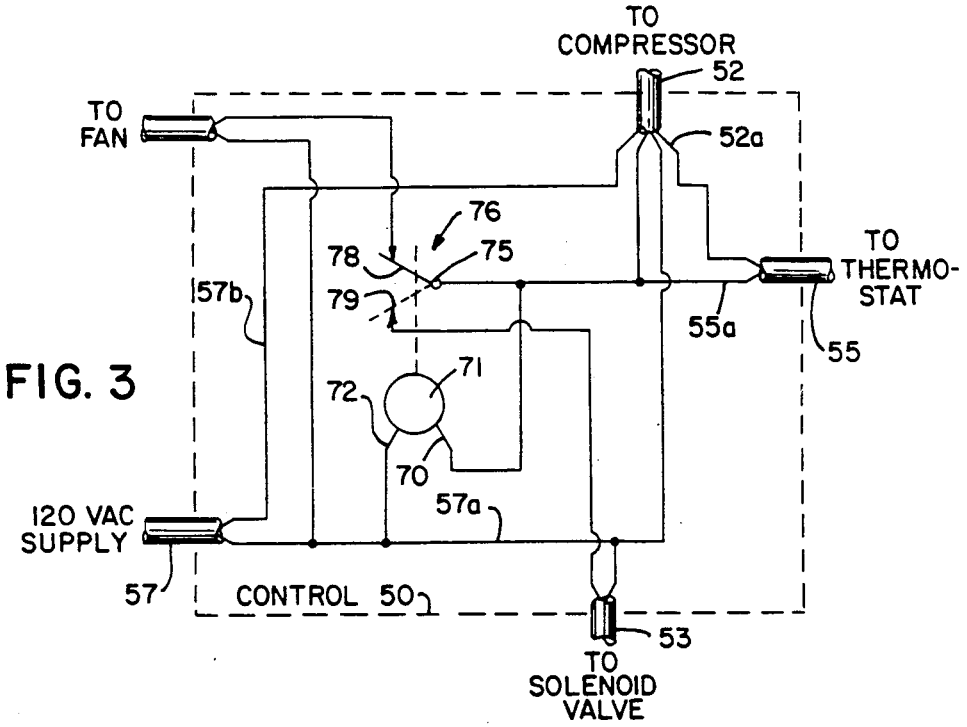
FIG. 3
FIG. 4
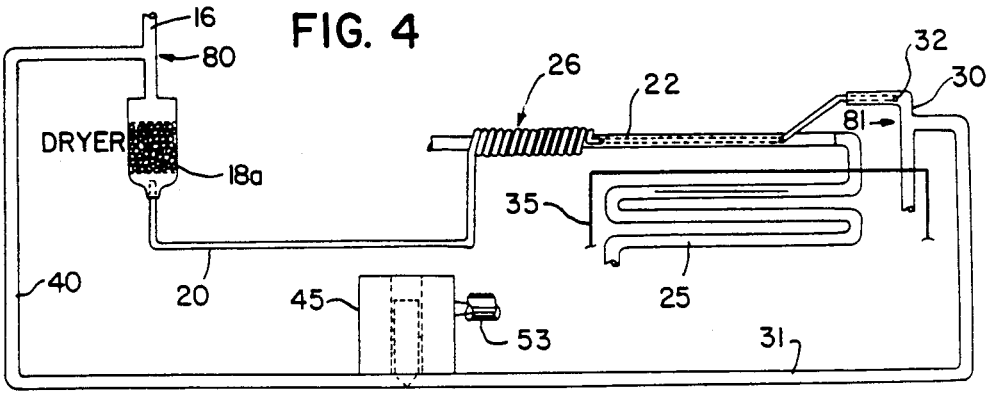

HOT GAS BYPASS DEFROSTING SYSTEM

BACKGROUND OF THE INVENTION

The field of the invention is defrosting apparatus for refrigeration units and more particularly, those systems incorporating modified refrigerant flow as a means of defrosting.

Refrigeration units generally consist of an electrically driven compressor, a condenser, an evaporator and a flow restricting device. The compressor inlet is connected to draw refrigerant from the evaporator, and the compressor outlet is connected to discharge the refrigerant under increased pressure and temperature to the condenser. Under such conditions, the hot refrigerant entering the condenser is cooled by external means, usually air or water, thereby extracting heat from the refrigerant. As the temperature of the refrigerant drops under substantially constant pressure, the refrigerant in the condenser liquifies, or condenses, thereby losing additional heat due to latent heat of vaporization for the refrigerant.

The flow restricting device, usually either a capillary tube or expansion valve, is connected between the condenser and evaporator so as to maintain the high pressure in the condenser and at the compressor outlet while simultaneously providing substantially reduced pressure in the evaporator. The substantially reduced pressure in the evaporator results in a large temperature drop and subsequent absorption of heat by the evaporator.

The very cold temperature of the evaporator can result in formation of frost thereon, which eventually results in the buildup of ice on the surface of the evaporator. As the ice continues to collect on the evaporator, the transfer of heat is reduced due to the insulative effect of the ice. Further, the ice reduces the available space in the refrigerated compartment, which can be especially detrimental in small freezer compartments. Consequently, in order to remove the accumulated ice, it is necessary to periodically defrost the evaporator.

The most common defrosting method is the use of electrical resistance heaters, usually referred to as "strip" heaters due to their placement in elongated strips along door edges where frost tends to first accumulate. Other defrosting systems are known in which the flow of pressurized refrigerant out of the compressor is reversed, sending the hot refrigerant from the compressor into the evaporator rather than the condenser, in essence making the "evaporator" function as the "condenser", and vice versa. This is also the same principle as used in reversible "heat pump" systems for alternately providing heating and air conditioning. One problem with the traditional flow reversal method is the downtime necessary to reverse the flow of refrigerant to commence the defrost cycle, and then to again commence flow in the original direction. The flow reversal also requires a fairly complicated piping and valving system to accomplish.

SUMMARY OF THE INVENTION

The present invention is applicable to a refrigeration apparatus of the type including a power driven compressor, a first heat exchanger, a flow restricting device and a second heat exchanger. In the refrigeration apparatus, the compressor discharges a refrigerant to an inlet of the first heat exchanger. The flow restriction device is connected to an outlet of the first heat exchanger and restricts the flow of refrigerant through the first heat exchanger to thereby cause condensation of the refrigerant in the first heat exchanger. The second heat exchanger is connected between an outlet of the restricting device and an inlet of the compressor, such that the condensed refrigerant entering the second heat exchanger from the restriction device evaporates to thereby extract heat from the second heat exchanger, with the evaporated refrigerant then being returned to the compressor to close the cycle.

The present invention is for an improvement in such a refrigeration apparatus, the improvement specifically providing for defrosting of the second heat exchanger. According to the invention, the refrigeration apparatus further comprises a bypass manifold, a second inlet port on the second heat exchanger and a bypass means. The bypass manifold is connected between the first heat exchanger and the restricting device, and includes first, second and third ports. The first and second bypass manifold ports are connected to the first heat exchanger and the restricting device, respectively. The first and third bypass manifold ports provide substantially unrestricted flow of refrigerant therebetween.

The bypass means is connected between the third port of the bypass manifold and the second inlet port on the second heat exchanger. The bypass means includes a flow switching device having a first state and a second state, in which flow of refrigerant through the bypass means is substantially blocked when the flow switching device is in the first state and in which flow of refrigerant through the bypass means is substantially unrestricted when the flow switching device is in the second state. As a result, when the flow switching device is in the first state the refrigerant flows substantially exclusively through the restricting device for normal refrigeration. Then, when the flow switching device is in the second state the refrigerant flows substantially exclusively and unrestricted through the bypass means to thereby deliver uncondensed refrigerant to the second heat exchanger for defrosting of the second heat exchanger.

An important object of the present invention is to provide a defrosting apparatus which is both inexpensive to fabricate and inexpensive to operate. The bypass means can be provided at a lower cost than prior separate heating means for defrosting purposes (e.g. electric strip heaters) and prior "heat pump" flow reversing systems. Compared to the later, the present invention utilizes less complicated valving due to the fact that the flow of refrigerant is not reversed. Instead, refrigerant flows in the same direction for both refrigeration and defrosting, but condensation of the refrigerant, and the attendant heat loss thereof, is defeated when the bypass means is placed in the second state to deliver uncondensed refrigerant gas to the second heat exchanger for defrosting. As compared to electrical resistance heaters, the defrosting apparatus according to the invention is more economical to operate. A portion of the heat delivered for defrosting is absorbed from the ambient environment, so that more heat is delivered than the electrical energy consumed.

The improved refrigeration apparatus according to the invention may further include a controller connected to the compressor and the flow switching device for changing the flow between the first and second states. The controller places the flow switching device in the first state for a first predetermined amount of total accumulated running time for the compressor, and then switches the flow switching device to the second state for a second predetermined amount of total accumulated running time for the compressor.

The advantage of economical defrosting is furthe enhanced by timing the defrost cycles relative to compressor running time rather than actual time. In that way, defrosting is performed on a more "as needed" basis instead of a fixed periodic interval. Further, the controller may switch the flow switching device to the second state at a time when the compressor is already energized, Which offers several advantages. First, the compressor is normally energized because refrigeration is desired, e.g. an enclosure to be refrigerated is at its warmest. Beginning a defrost cycle at that point assures minimum energy waste for the defrost cycle. Secondly, when the compressor is energized in a refrigeration mode, the first heat exchanger becomes very hot due to the high pressure discharge of refrigerant from the compressor. When beginning a defrost cycle immediately following such a refrigeration cycle, the heat stored in the hot first heat exchanger is essentially recovered by delivering that heat to the second heat exchanger for defrosting purposes. Therefore, not as much energy needs to be added to the system to perform defrosting.

The bypass manifold in the improved refrigeration apparatus according to the invention may comprise a dual port dryer, and the restricting device may comprise a capillary tube emanating from the dual port dryer. The second inlet port on the second heat exchanger may comprise a connecting tube connected between the flow switching device and the second heat exchanger, with the capillary tube entering the second heat exchanger by passing through a wall of the connecting tube, through the interior of the connecting tube, and into the interior of the second heat exchanger.

One object of the invention is to facilitate fabrication of the refrigerating apparatus. By utilizing a connecting tube between the flow switching device and the second heat exchanger, the capillary tube may be pre-assembled to the connecting tube by routing the capillary tube down the interior of the connecting tube. The capillary tube/connecting tube assembly may then be attached to the second heat exchanger at a later stage in the fabrication the refrigerating apparatus, resulting in an overall reduction in fabrication complexity.

The foregoing and other objects and advantages of the invention will appear from the following description. In the description, reference is made to the accompanying drawings which form a part hereof, and in which there is shown by way of illustration a preferred embodiment of the invention. Such embodiment does not represent the full scope of the invention, however, and reference is made therefore to the claims herein for interpreting the scope of the invention.

BRIEF DESCRIPTION OF THE DRAWINGS

FIG. 2 is a detailed plan view of the routing of the capillary tube to the evaporator in the hot gas bypass defrosting system of FIG. 1;

FIG. 3 is an electrical schematic diagram of the control circuit which forms a part of the hot gas bypass defrosting system of FIG. 1; and FIG. 4 is a partial block diagram of a second embodiment of a hot gas bypass defrosting system according to the present invention.

DESCRIPTION OF THE PREFERRED EMBODIMENT

Figure 1:
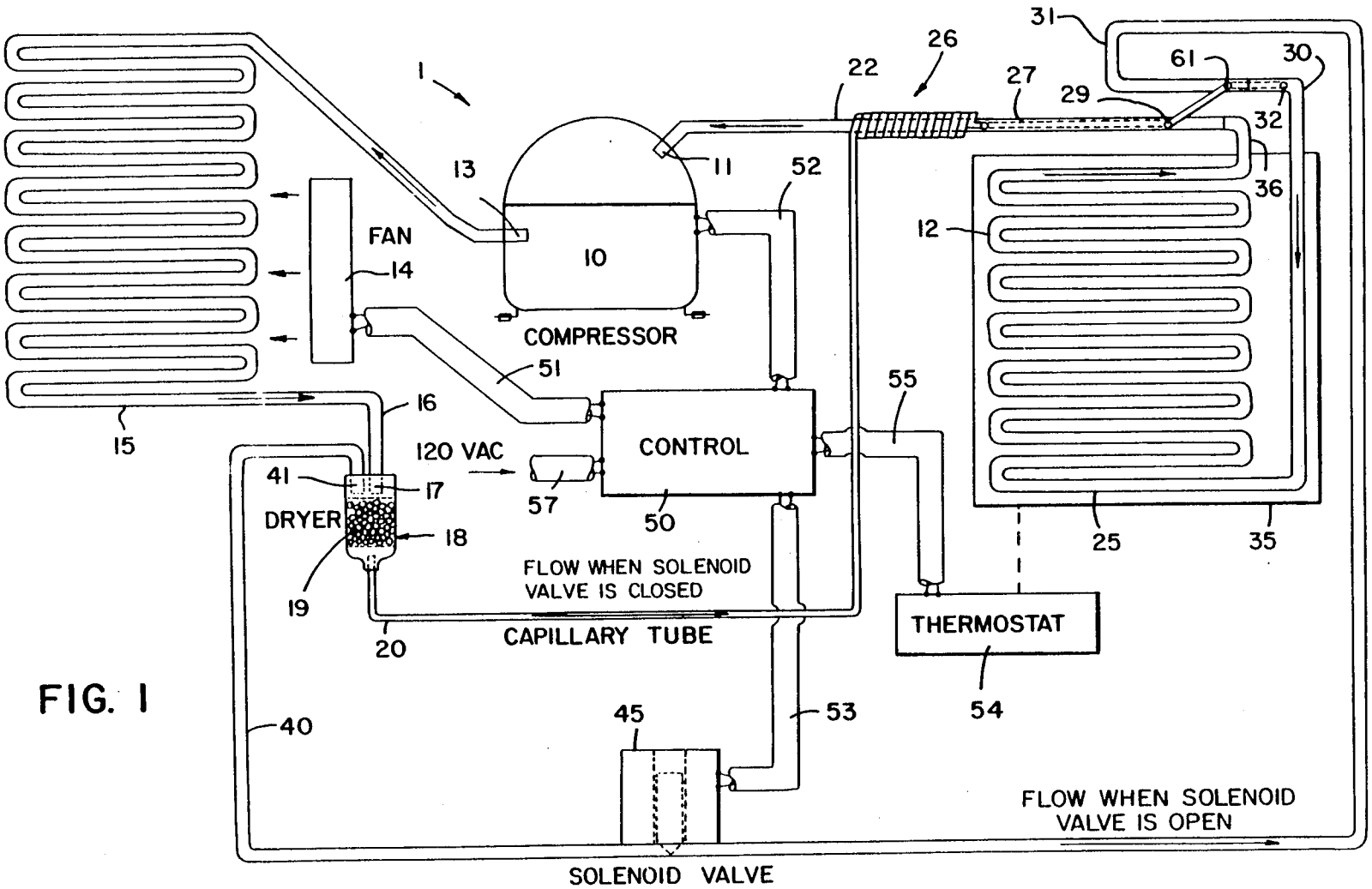
FIG. 1 is a block diagram of a refrigeration system employing a hot gas bypass defrosting system according to the present invention.

Referring to FIG. 1, a refrigeration system 1 provides conventional refrigeration and also provides for defrosting of the refrigerated space by altering the flow of refrigerant through the system 1. In the description which follows, the flow of refrigerant through the system 1 during refrigeration is described first. Then, the novel modifications to the refrigerant flow according to the invention are described which result in a highly economical means for defrosting the refrigerated space.

A compressor 10 includes a suction inlet 11 for drawing refrigerant from a suction tube 22. The compressor 10 then compresses the refrigerant and discharges it out through a discharge outlet 13 to a first heat exchanger 15. The first heat exchanger 15 which receives the high temperature, high pressure discharge from the compressor 10 is usually referred to as a "condenser" in prior systems. However, as will be described in detail below, the first heat exchanger 15 at times operates in a mode in which the refrigerant does not necessarily condense, and so the use of the term "condenser" in regard to the first heat exchanger 15 of the present invention may be a misnomer. For the same reason, a second heat exchanger 25 which has in prior systems been referred to as an "evaporator" is instead referred to herein as the second heat exchanger 25.

A fan 14 is provided for blowing air over the first heat exchanger 15 to accelerate the removal of heat therefrom. An outlet tube 16 of the first heat exchanger 15 is connected to one inlet port 17 of a dual port dryer 18. The second port 41 of dryer 18 is used during defrosting, and is described in detail below. The dryer 18 includes a quantity of desiccant beads 19 for extracting any residual moisture from the refrigerant, as is generally practiced in the prior art. A capillary tube 20 is connected as an outlet of dryer 18 and is routed to suction tube 22 of second heat exchanger 25. The capillary tube 20 has a very small diameter which functions as a restricting device, providing a measured amount of resistance to the flow of refrigerant therethrough. The capillary tube 20 is wrapped around suction tube 22 of the second heat exchanger 25 for approximately 18 turns, shown generally at 26, and then penetrates through an outside wall of suction tube 22 to travel down the interior of suction tube 22 as shown by dotted lines 27. The turns 26 and the section 27 of capillary tube 20 establish thermal contact between suction tube 22 and capillary tube 20, thereby providing heat recovery for the respective refrigerants therein.

Capillary tube 20 exits from the interior of suction tube 22 at a point 29 near an inlet tube 30 of second heat exchanger 25. The capillary tube 20 is then routed through a wall of a first connecting tube 31, down the interior of first connecting tube 31, and into the interior of inlet tube 30. The capillary tube 20 terminates in an open end 32, to discharge refrigerant into the interior of inlet tube 30, with the refrigerant then flowing through inlet tube 30 into the second heat exchanger 25. The second heat exchanger 25, which as discussed above normally functions as an evaporator, is usually disposed inside an insulated enclosure 35, such as, for example, a refrigerator, ice making apparatus or the like. The refrigerant flows through the second heat exchanger 25 to an outlet tube 36. The outlet pipe 36 connects in turn to the suction tube 22, for conducting the refrigerant back to inlet 11 of compressor 10.

The above described components provide a path for the flow of refrigerant in a normal refrigeration mode. In this embodiment, however, a second alternate path for the flow of refrigerant is provided to apply heat to the second heat exchanger 25 instead of cooling it, thereby providing for defrosting of the second heat exchanger 25. The alternate refrigerant path comprises a second connecting tube 40, solenoid valve 45, and first connecting tube 31. The second connecting tube 40 is connected between second port 41 of dryer 18 and the solenoid valve 45. The solenoid valve 45 is electrically operated to alternately provide either substantially unrestricted flow of refrigerant from tube 40 through to the first connecting tube 31, or to substantially block the flow of refrigerant from tube 40 to tube 31.

When the solenoid valve 45 is closed, the flow of refrigerant through tube 40 is substantially blocked, so that the only outlet for the refrigerant entering through inlet port 17 of dryer 18 is by means of the capillary tube 20. The capillary tube 20 presents enough resistance to the flow of refrigerant such that a back pressure is developed and maintained in the first heat exchanger 15 and at the compressor discharge outlet 13. Because of the high pressure and low flow rate, the refrigerant lingers in the first heat exchanger 15 long enough to condense, thereby turning to liquid before passing into capillary tube 20. The liquid refrigerant then flows through capillary tube 20 and flashes into vapor upon emerging from open end 32 in the inlet port 30 of the second heat exchanger 25. The cooled refrigerant gas then passes through the second heat exchanger 25, extracting heat from enclosure 35 before being drawn back to the suction inlet 11 through suction tub 22.

Alternately, when defrosting of the enclosure 35 is desired, the solenoid valve 45 is opened and a substantially unrestricted flow of refrigerant is provided through tubes 40 and 31 to the inlet 30 of second heat exchanger 25. The tubes 40 and 31 are substantially larger in diameter than the capillary tube 20, so that essentially all of the refrigerant entering the dryer 18 through inlet port 17 flows into tube 40 instead of capillary tube 20. In fact, the difference of the respective flow restrictions between capillary tube 20 and the alternate path provided by tubes 40 and 31 is so great that there is essentially no flow through capillary tube 20 when solenoid valve 45 is open. It is therefore not necessary to provide any other means such as, for example, a second solenoid in capillary tube 20, to prevent flow of refrigerant therethrough.

Because of the low flow restriction when the solenoid valve 45 is open, there is essentially no back pressure at the outlet pipe 16 of first heat exchanger 15, and the refrigerant discharge from compressor 10 flows freely therethrough. The refrigerant in the first heat exchanger 15 is therefore at a somewhat elevated temperature and pressure although substantially less than the temperature and pressure to which the refrigerant is subjected in the refrigeration mode described above. Because of the relatively lower temperature and rapid transit through the first exchanger 15, the refrigerant normally passes therethrough without condensing, exiting through outlet tube 16 and into the inlet 17 of dryer 18 as a hot gas. Since no condensation occurs, the heat lost in the first heat exchanger 15 is limited to the temperature drop of the refrigerant; the latent heat of vaporization normally lost during refrigeration is retained by the refrigerant. The hot gas thus entering the dryer 18 then flows freely from inlet port 17, out through port 41, into tube 40, past the solenoid valve 45, through tube 31, and into the inlet tube 30 of the second heat exchanger 25. Upon entering the second heat exchanger 25, the hot refrigerant gas has the effect of warming the second heat exchanger 25 to thereby melt any frost or ice which may have accumulated thereon. The hot gas then flows out of outlet port 36 back to the compresso 10 to close the cycle.

Still referring to FIG. 1, a control circuit 50 is provided for controlling the electrically operated components of the system, specifically the compressor 10, the fan 14 and the solenoid valve 45. An electrical source voltage, for example, 120 volts alternating current (VAC) is supplied to the control circuit 50 via input cable 57 Electrical cables 51-53 are connected between the controller 50 and fan 14, compressor 10 and solenoid valve 45, for providing operating voltage to those respective devices. A thermostat 54 which is in thermal contact with the enclosure 35 is also connected to the control circuit 50 via cable 55 as an input to regulate the temperature inside enclosure 35.

The dryer 18 preferred in this embodiment is of a dual port type which have been known and used in prior systems which incorporated dual parallel condensers feeding the dual dryer ports. As discussed above, the present invention utilizes the second port 41 on dryer 18 is a substantially different manner, i.e. as an alternate outlet from dryer 18 for the low restriction, hot gas bypass operation described above, instead of as a second inlet port from a parallel condenser. This novel use of dual port dryer 18 serves in essence as a manifold, providing an alternate path for refrigerant flow as described above, with a minimum of connections and utilizing an inexpensive, commonly available part.

Referring now to FIG. 2, the routing of the capillary tube 20 around and through the suction tube 22 and the first connecting tube 31 is another important part of this invention. In prior systems, the capillary tube had to be sealed into an open end of an evaporator inlet tube. As a result, the connection of the capillary tube to the evaporator in prior systems had to be accomplished at a later stage in the manufacturing process, with all of the components essentially in place. However, since a separate connecting tube 31 is utilized in the present invention, the capillary tube 20 is instead preferably routed through the interior o first connecting tube 22 before entering inlet tube 30 of the second heat exchanger 25. In that way, the tubes 22 and 31 may be prefabricated as an assembly at an earlier stage in the manufacturing process, prior to connection to the second heat exchanger 25. Specifically, the first connecting tube 31 has one end 60 enlarged to mate with the inlet tube 30 of the second heat exchanger 25. The capillary tube 20 is routed through a wall of first connecting tube 31 at a point 61 approximately six inches (shown at 64) from the enlarged end 60. The capillary tube 20 then runs through the interior of the first connecting tube 31, and extends out of the enlarged end 60 for a length (shown at 65) of approximately three inches. The penetrations of the capillary tube 20 through the walls of tubes 22 and 31 are sealed, for example, by soldering. The first connecting tube 31 may then be subsequently connected to the inlet tube 30 of second heat exchanger 25 by simply inserting the three inch length 67 of capillary tube 20 into the interior of inlet tube 30, while placing the enlarged end 60 of second connecting tube 31 over the inlet pipe 30. The connection between the tubes 30 and 31 are then sealed, for example, by soldering.

Referring to FIG. 3, the 120 VAC supply voltage on cable 57 comprises a neutral wire 57*a*, essentially at ground potential, and a "hot" wire 57*b* having the 120 VAC supply voltage impressed thereon. The neutral wire 57*a* is connected as one input to each of the cables 51–53 for the fan 14, compressor 10, and solenoid valve 45, respectively. The hot wire 57*b* is connected as one lead in compressor cable 52, which is routed to an overload cutout switch (not shown) in thermal contact with the compressor 10. A return wire 52*a*, also connected to the overload cutout switch, is therefore normally energized, provided that the overload cutout switch has not opened due to an overload of the motor (not shown) driving the compressor 10. Return wire 52*a* is connected as one lead in thermostat cable 55. The return lead 55*a* from thermostat cable 55 will thereby be energized (again except for compressor overload) whenever the thermostat contacts (not shown) are closed, i.e. demanding refrigeration. The return wire 55*a* from thermostat 55 is connected as follows; to another lead in compressor cable 52 for energizing the compressor motor, to on input 70 of a timing motor 71, and to a center pole 75 of a set of double throw switch contacts 76. A second input 73 for timing motor 71 is connected to the neutral wire 57*a*, such that the timing motor 71 is energized in parallel with the compressor 10. The timing motor 71 mechanically drives the contacts 76 between a refrigeration position shown by solid line 78, and defrost position shown by dotted line 79.

Timing motors per se have been known and used in prior systems for controlling the defrost cycles thereof. However, in such prior systems the timing motors were connected directly to the input voltage to run constantly and thereby engage the defrost cycle on a periodic basis with respect to actual time, for example, every 48 hours, 72 hours, etc. A novel feature of the present invention is that the timing motor 71 is instead connected to the return lead 55*a* from thermostat 55. The timing motor 71 therefore runs only when the compressor 10 is also energized. The timing motor 71 is therefore responsive to running time of the compressor 10, rather than to actual time, so as to provide more efficient timing of the defrost cycles. For example, if a refrigerator is used more heavily in terms of door openings and closings, the compressor 10 will tend to run more frequently, and frost will accumulate on the second heat exchanger 25 more frequently. Conversely, during times of low usage, the compressor 10 may cycle relatively infrequently and frost will not accumulate on the second heat exchanger 25 as rapidly. The timing motor 71 and contacts 76 are set to switch to the defrost position 79 after a total run time of approximately twelve hours for compressor 10. It is further important to note that because the timing motor 71 and compressor 10 are energized in parallel, the defrost position 79 can only be engaged when the compressor 10 is already energized and running. When the predetermined run time for the compressor has elapsed, the contacts 76 simply move from position 78 to position 79 to initiate a defrost cycle while the compressor 10 continues to run.

With the contacts 76 in position 78 (refrigeration), the return line 55*a* from thermostat 55 is connected through to the fan 14 to provide accelerated heat transfer for the first heat exchanger 15. When the contacts 76 are moved down to position 79 for defrosting, the compressor 10 continues to run without interruption. The fan 14 is deenergized, and the 120 VAC on line 55*a* is coupled through to a hot lead 53*a* on cable 53 to solenoid valve 45. This energizes the solenoid valve 45 to modify the refrigerant flow as described above and provide defrosting of the second heat exchanger 25. Since heat is now being applied to second heat exchanger 25 instead of refrigeration, the thermostat 54 will not be satisfied, i.e. will remain closed, for the duration of the defrost cycle. The timing motor 71 is set up to provide a fixed duration defrost cycle lasting approximately 15 minutes. After the defrost cycle has been completed, and with the compressor 10 still continuously running, the contacts 76 are returned to position 78, deenergizing the solenoid valve 45 and reenergizing the fan 14. Now, refrigeration is reapplied to the second heat exchanger 25 to immediately begin recooling the enclosure 35 after the defrost cycle has been completed.

The hot gas bypass defrost system according to the present invention is therefore extremely advantageous and efficient for several reasons. First of all, the defrost cycle is initiated only when the enclosure 35 is at its warmest, i.e. with thermostat 54 already demanding refrigeration. Then, the compressor 10 is run continuously through refrigeration, defrost, and re-refrigeration, which not only saves on wear and tear of the compressor 10, but also saves the proportionately larger amount of electrical energy needed for starting. Finally, better temperature regulation is provided for the enclosure 35 due to the immediate resumption of refrigeration following the defrost cycle and because of the fact that the refrigeration and defrost cycle are precluded from overlapping, i.e. they cannot "buck" each other.

In the above described embodiment, the fan 14 is shut off during the defrosting cycle to prevent excessive heat loss in the refrigerant, since it is desired to deliver hot refrigerant to the second heat exchanger 35 for defrosting purposes. Not running the fan 14 during the defrost cycles also saves energy, resulting in a more economical defrosting operation. However, care must be taken to insure that the overall heat loss throughout the system is sufficient to prevent overheating of the motor (not shown) which drives the compressor 10. Under normal conditions, for example in household type refrigerated appliances, the first heat exchanger 15 exhibits enough static heat loss with the fan 14 off such that with the added heat loss in the second heat exchanger 25, the overall system heat loss during defrosting has been found to be sufficient. As an alternative, the fan 14 could be engaged during the defrost cycle, either always or in response to an overtemperature sensor, to prevent overheating if the static heat loss of the first heat exchanger 15 is not sufficient.

In general terms, the invention requires a bypass manifold, or three way connection, between the first heat exchanger and the restricting device. In the first embodiment described above, the manifold comprised the dual port dryer 18, although it should be apparent to those skilled in the art that many alternate connections are possible to achieve the same result. For example, there is shown in FIG. 4 a second embodiment of the invention in which the bypass manifold comprises a "tee" fitting 80 connected between the outlet 16 of the first heat exchanger 15 and the input of a conventional single inlet dryer 18*a*. Similarly, the second heat exchanger 25 in general requires a second inlet for the first connecting tube 31, in addition to the inlet for the restricting device. An advantageous means for providing the second inlet for the second heat exchanger 25 is described in the first embodiment above, i.e. the the first and second inlets are concentric, with the capillary tube 20 disposed inside of the first connecting tube. Alternately, the second inlet for the second heat exchanger 25 may be provided by a second "tee" fitting 81 as shown in the second embodiment of FIG. 4. In that case, the capillary tube 20 may be soldered directly into the open end of inlet tube 30 as is the common practice in the prior art. The "tee" fitting 81 may then be placed in-line with inlet tube 30, and the first connecting tube 31 attached to the open port of "tee" fitting 81. While the second embodiment of FIG. 4 is somewhat less advantageous for new systems, it should be noted that a prior, non-bypassing system could be retrofitted according to the second embodiment to practice the invention.

As yet another alternative to the above described embodiments, the restricting device may comprise any known devices for accomplishing a purpose equivalent to that of the disclosed capillary tube. For example, expansion valves are another known expedient for providing a restriction to refrigerant flow.

Finally, the function served by the solenoid valve 45 in the above described embodiments is that of a flow switching device for alternately either allowing or blocking flow therethrough. It should be apparent to those skilled in the art that many other types of flow switching devices may be used with the scope of this invention, including motor driven valves, manual valves, and mechanically operated valves. In the latter two examples, timed operation of the flow switching device is not absolutely necessary. For example in a large system, it may be feasible to perform defrosting manually when deemed necessary by the observation of an operator. Another alternative may be to include a mechanical sensor for physically detecting the build up of ice to a predetermined thickness, in which case the mechanical sensor may operate the flow switching device either through a direct mechanical linkage or by means of an electrical control circuit (not shown).

We claim:

1. In a refrigeration apparatus of the type including a power driven compressor for discharging a refrigerant to an inlet of a first heat exchanger, a flow restriction device connected to an outlet of the first heat exchanger for restricting the flow of refrigerant through the first heat exchanger to thereby cause condensation of the refrigerant in the first heat exchanger, and second heat exchanger connected between an outlet of the restricting device and an inlet of the cmopressor, whereby the condensed refrigerant entering the second heat exchanger from the restriction device evaporates to thereby extract heat from the second heat exchanger, the improvement for providing defrosting for the second heat exchanger in which the refrigeration apparatus further comprises:

a bypass manifold comprising a dual port dryer including a first port connected to the first heat exchanger, a second port connected to a capillary tube restricting device emnating from the dual port dryer, and a third port which provides substantially unrestricted flow of refrigerant between the first and third ports;

a second inlet port on the second heat exchanger; and bypass means connected between the third port of the dual port dryer and the second inlet port on the second heat exchanger, the bypass means including a flow switching device having a first state and a second state, in which flow of refrigerant through the bypass means is substantially blocked when the flow switching device is in the first state and in which flow of refrigerant through the bypass means is substantially unrestricted when the flow switching device is in the second state;

whereby when the flow switching device is in the first state the refrigerant flows substantially exclusively through the capillary tube restricting device for normal refrigeration, and when the flow switching device is in the second state the refrigerant flows substantially exclusively and unrestricted through the bypass means to thereby deliver uncondensed refrigerant to the second heat exchanger for defrosting of the second heat exchanger.

2. The refrigeration apparatus of claim 1 which further includes a controller connected to the compressor and the flow switching device, the controller being capable of changing the flow switching device between the first and second states, whereby the controller places the flow switching device in the first state for a first predetermined amount of total accumulated running time for the compressor, and then switches the flow switching device to the second state for a second predetermined amount of total accumulated running time for the compressor.

3. The refrigeration apparatus of claim 1 in which the controller switches the flow switching device to the second state at a time when the compressor is already energized.

4. The refrigeration apparatus of claim 1 in which the second inlet port on the second heat exchanger comprises a connecting tube connected between the flow switching device and the second heat exchanger, with the capillary tube entering the second heat exchanger by passing through a wall of the connecting tube, through the interior of the connecting tube, and into the interior of the second heat exchanger.

* * * * *

UNITED STATES PATENT AND TRADEMARK OFFICE

CERTIFICATE OF CORRECTION

PATENT NO. : 5,065,584

DATED : November 19, 1991

INVENTOR(S) : Dean G. Byczynski et al.

It is certified that error appears in the above-identified patent and that said Letters Patent is hereby corrected as shown below:

In Column 3, Line 5, change "furthe" to --further--.

In Column 6, Line 48, change "o" to --of--.

In Column 9, Line 51, Claim 1, change "cmopressor" to --compressor--.

In Column 10, Line 6, Claim 1, change "emnating" to --emanating--.

Signed and Sealed this

Sixteenth Day of March, 1993

*Attest:*

STEPHEN G. KUNIN

*Attesting Officer*

*Acting Commissioner of Patents and Trademarks*